US005129151A

United States Patent [19]

Kim et al.

[11] Patent Number: 5,129,151

[45] Date of Patent: Jul. 14, 1992

[54] ROOF PANEL MODULE GAUGE

[75] Inventors: Kwon S. Kim, Oklahoma City; Clarence S. Salisbury, Moore; Dennis P. Watson, Oklahoma City, all of Okla.

[73] Assignee: Robertson-Ceco Corporation, Pittsburgh, Pa.

[21] Appl. No.: 813,576

[22] Filed: Dec. 26, 1991

[51] Int. Cl.[5] ..... G01D 21/00; B25B 1/20

[52] U.S. Cl. ..... 33/613; 269/904

[58] Field of Search ..... 33/613; 269/43, 904, 269/237

[56] References Cited

U.S. PATENT DOCUMENTS

| | | | |
|---|---|---|---|
| 2,686,959 | 4/1954 | Robinson | 33/613 |
| 4,322,064 | 3/1982 | Jarvis | 269/904 X |
| 4,420,921 | 12/1983 | Hardin | 52/749 |
| 4,704,829 | 11/1987 | Baumker | 33/613 X |

*Primary Examiner*—Harry N. Haroian

*Attorney, Agent, or Firm*—George E. Manias

[57] ABSTRACT

A module gauge is described for moduling the next-to-be-erected roof panel to conform its actual width with the design modular width by compressing or expanding the roof panel as needed. Conformation of the panel widths results in a weathertight roof structure.

16 Claims, 4 Drawing Sheets

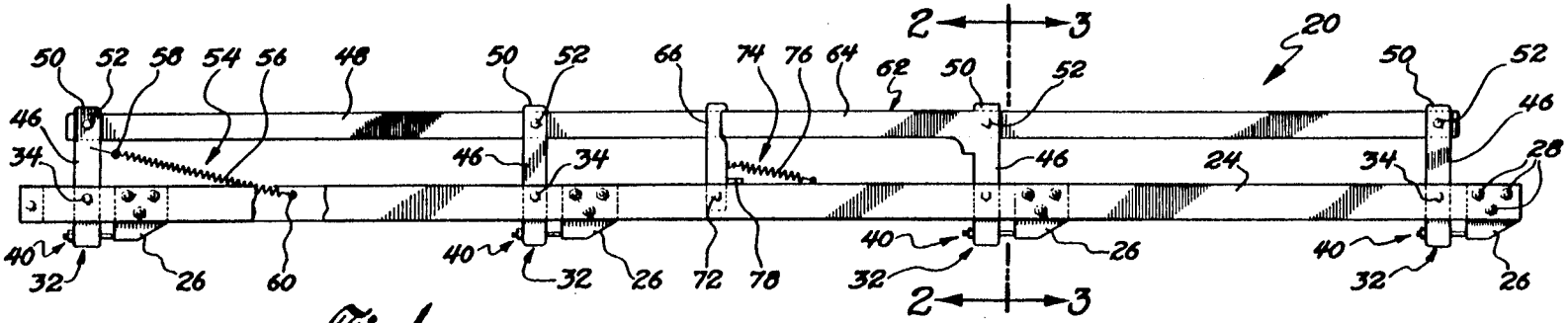
Fig. 1
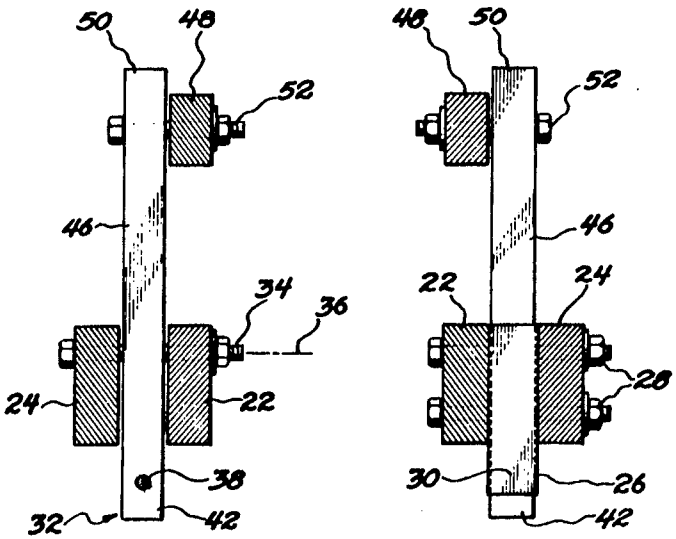
Fig. 2
Fig. 3
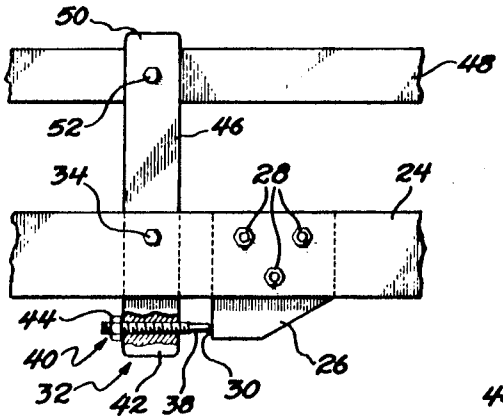
Fig. 4
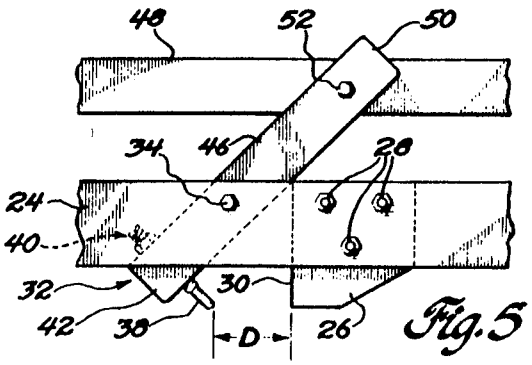
Fig. 5

ROOF PANEL MODULE GAUGE

BACKGROUND OF THE INVENTION

1. Field of the Invention

The present invention relates to a module gauge, and more particularly to a gauge for conforming the width of the next-to-be-erected roof panel to the design modular width.

2. Description of the Prior Art

Standing seam roof panels are factory roll-formed from 22 or 24 gauge sheet metal, and usually have a modular width of 24 inches (9.45 cm). After the roof panels are installed and seamed in place, the ribs are 2¾ to 3 inches (1.08 to 1.18 cm) high and have a unique rolled seam to provide maximum weathertightness.

It is essential that the modular width be maintained during field installation. However it is difficult to do so under actual field conditions. The cause of modular width variations can be attributed to variations in the sheet metal thickness and of the thickness of the decorative and/or protective coating which must be accommodated by the rolls of the roll forming equipment; and coil-to-coil variations in the physical properties of the steel. These variations cause varying degrees of permanent set and spring back in the material being roll formed thereby causing variations in the final shape of the panel and hence in the modular width of the panel.

The method of crating the roof panels and handling and shipment thereof cause some panels to be wider than desired and other panels to be narrower than desired.

All roof installations must be engineered assuming the design modular width. The panel members must be installed to provide the design modular width coverage regardless of the actual width of the individual roof panel members. However, since the panel coverage cannot be precisely controlled at the time of manufacture or maintained during handling and shipping, it is desirable that some means be provided for "moduling" the panels, that is, for physically stretching or compressing the out-of-tolerance panel member across its width to conform its width to the design modular width.

Tools are known for maintaining objects, such as, 2×4's and roof trusses, in uniformly spaced relation while they are secured in place, see for example U.S. Pat. Nos. 2,686,959 (ROBINSON), 4,322,064 (JARVIS) and 4,420,921 (HARDIN). None of these devices are suitable or modifiable for use in erecting standing seam roof panels.

SUMMARY OF THE INVENTION

The principal object of the present invention is to provide a module gauge capable of clamping and locking multiple roof panels in one motion while moduling the next-to-be-erected roof panel.

Another object of this invention is to provide a module gauge by which the width of the next-to-be-erected panel is conformed to the design modular width by transversely stretching or compressing the roof panel as needed.

Still another object of this invention is to provide a module gauge by which the roof panel coverage is made to conform to that required by the structural framework of a building.

A further object of this invention is to provide a module gauge by which accurate panel coverage is assured thereby eliminating water leakage caused by misalignments in the roofing system.

In its broadest aspects, the present invention provides a module gauge comprising at least one elongated member having plural abutment means secured thereto at uniformly spaced locations thereon. Clamping means are provided, each pivotally connected to the elongated member for arcuate movement toward and away from the clamping means. Manual operating means is provided for effecting pivotal movement of the clamping means, in unison, into clamping relation with abutment means.

In the preferred embodiment, the module gauge incorporates a pair of the elongated members thereby providing a stable pivotal connection between the clamping means and the elongated members.

In the present module gauge, the operating mean comprises plural crank means, each associated with one of the clamping means; a tie member extending across and pivotally connected to the crank means; and operating arm means for moving the tie member and hence pivotally moving the clamping means in unison.

BRIEF DESCRIPTION OF THE DRAWINGS

FIG. 1 is side view of the present module gauge;

FIG. 2 is cross-sectional view taken along the line 2—2 of FIG. 1, further illustrating the clamping means;

FIG. 3 is cross-sectional view taken along the line 3—3 of FIG. 1, further illustrating the abutment means;

FIG. 4 is fragmentary side view illustrating clamping means and abutment means disposed in clamping relation;

FIG. 5 is fragmentary side view illustrating clamping means and abutment means disposed in spaced-apart relation;

DESCRIPTION OF THE PREFERRED EMBODIMENT(S)

Figure 6:
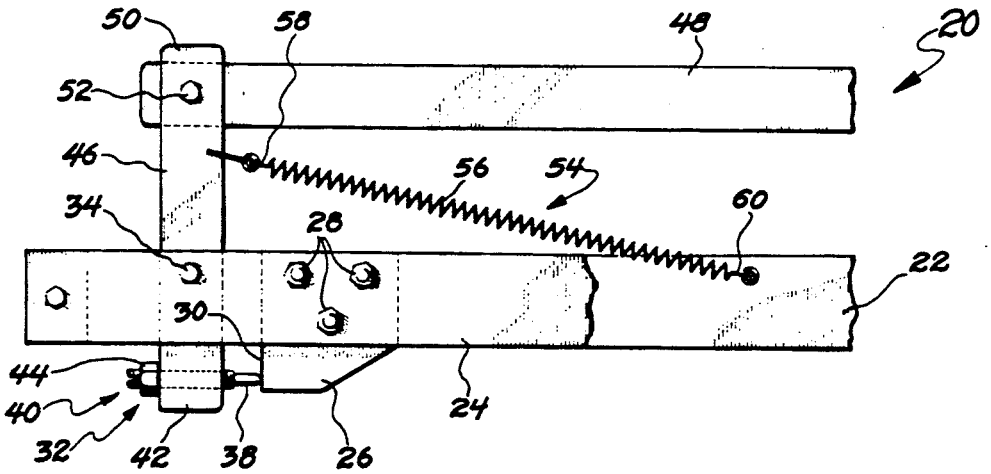
FIG. 6 is a fragmentary side view illustrating resilient means for urging the clamping means away from the abutment means.

Referring to FIGS. 1 through 5, the module gauge 20 of this invention, comprises at least one and preferably tow elongated members 22, 24 arranged in side-by-side parallel relation and having plural abutment means 26 disposed between and secured to the elongated members 22, 24 by fastener means 28 (FIGS. 1, 3 to 5). Each abutment means 26 presents a face 30 which preferably is generally perpendicular to the elongated members 22, 24. Plural clamping means 32 are provided, each pivotally connected to the elongated members 22, 24 by pivot means 34 (FIG. 2) and pivotal about an axis 36 generally perpendicular to the elongated members 22, 24. The arrangement is such that the clamping means 32 undergo arcuate movement toward and away from the adjacent abutment means 26. That is, the clamping means 32 is pivotable into clamping relation with the abutment means 26 as shown in FIG. 4, and pivotable into spaced-apart relation with the abutment means 26 as shown in FIG. 5. The clamping means 32 is, as shown in FIG. 5, spaced from the face 30 of the abutment means 26 at a distance indicated at D. In an operating embodiment, the distance D is about 1.875 inches (0.74 cm).

As shown in FIG. 4, the clamping means 32 includes a clamping element 38 and adjustment means 40 for adjusting the relative spacing (distance D) between the clamping element 38 and the face 30 of the adjacent abutment means 26. The adjustment means 40 may, for example, comprise having the clamping element 38 threadedly engaged with the portion 42 of the clamping means 32 and including a locknut 44 for fixing the clamping element 38 in the adjusted position.

The module gauge 20 additionally includes plural crank means 46 each associated with, that is supporting one of the clamping means 32. The crank means 46 are disposed between and are pivotally connected to the elongated members 22, 24 by the pivot means 34. A tie member 48 extends across the upper ends 50 of the crank means 46 and is pivotally connected to each crank means 46 by second pivot means 52 (FIGS. 2, 3). As will be explained, the movement of the tie member 48 results in simultaneous arcuate movement of all of the clamping means 32. That is, the clamping means 32 move, in unison, toward the abutment means 26 (FIG. 4) and away from the abutment means 26 (FIG. 5). First biasing means 54 (FIG. 6), such as the spring member 56, has a first end 58 secured to the crank means 46 and an opposite or second end 60 secured to one or both of the elongated members 22, 24. The first biasing means 54 is arranged to urge the clamping means 32 away from and into the spaced-apart relation with respect to the abutment means 26 as illustrated in FIG. 5.

Figures 9, 10, 11, 12:
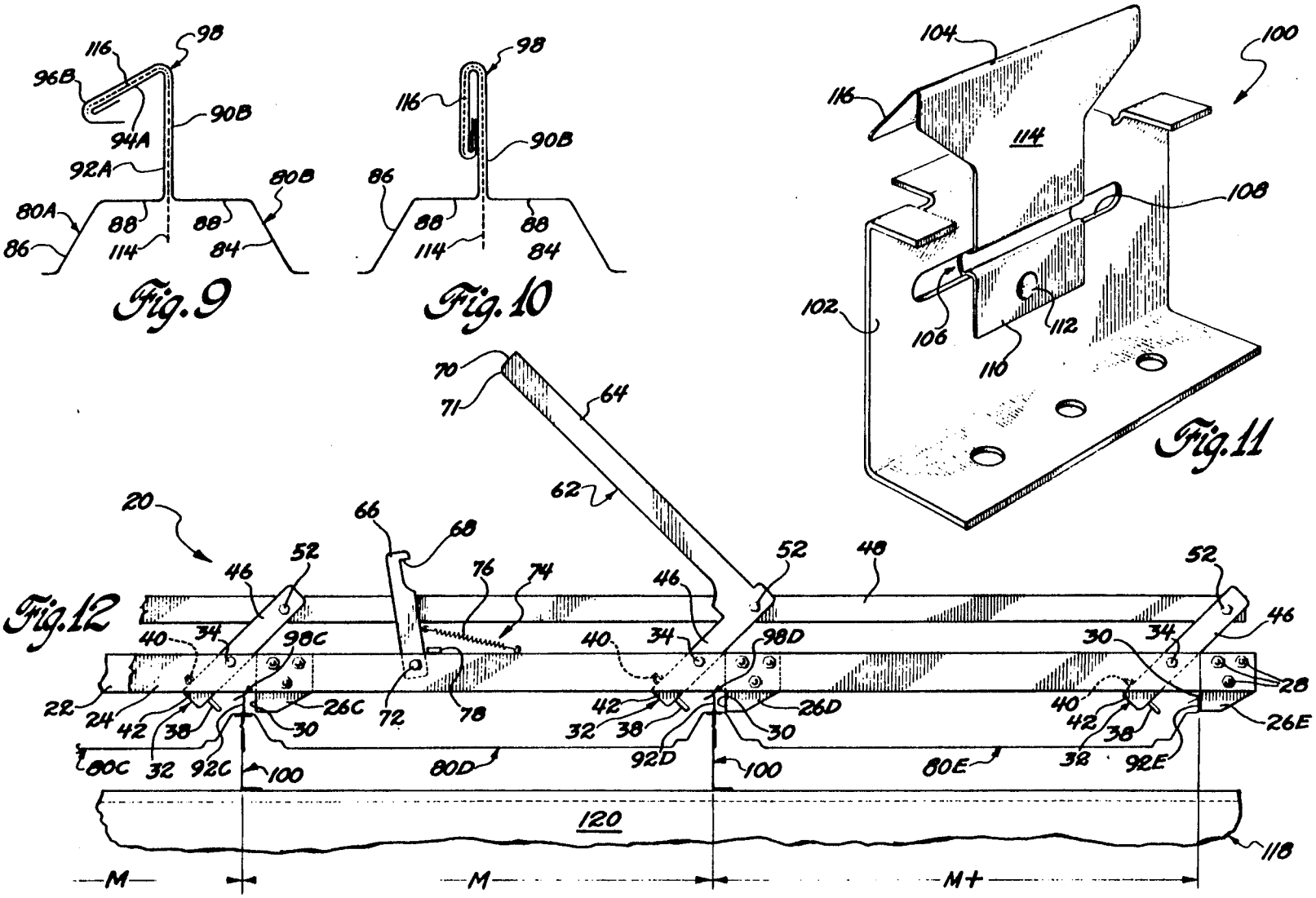
FIG. 9 is a fragmentary view of a panel joint prior to the seaming operation.
FIG. 10 is a fragmentary view of a panel joint after the seaming operation.
FIG. 11 is an isometric view illustrating clip means used to secure the roof panel of FIG. 8 to supporting steel purlins.
FIG. 12 is a side view of the present module gauge positioned to conform an over-width roof panel to the design modular width.

The module gauge 20 also incorporates manual operating means 62 (FIGS. 1, 7) for effecting pivotal movement of the clamping means 32, in unison, into clamping relation with the abutment means 26. The operating means 62 (FIG. 7) comprises arm means 64 which preferably extends from and generally perpendicular to one of the crank means 46. The arm means 64 is long enough to provide sufficient leverage for easy operation of the module gauge 20. In an operating embodiment of the gauge 20, the arm means 64 had a length L of 13.375 inches (5.265 cm). Lifting the arm means 64 causes pivoting of all of the crank means 42 and clamping means 32, in unison, as shown in FIG. 12.

Releasable latch means 66 is provided having a recess 68 which receives the remote end 70 of the arm means 64, to maintain the clamping means 32 in clamping relation with the abutment means 26. The latch means 66 is pivotally connected at 72 to one and preferably both of the elongated members 22, 24. The remote end 70 presents an arcuate portion 71, the outer surface of which serves as a cam surface. When the arm means 64 descends from the raised position of FIG. 12, the arcuate portion 71 deflects the latch means 66 away from the arm means 64 thereby allowing the remote end 70 of the arm means 64 to enter the recess 68.

Second biasing means 74 (FIG. 7), such as spring member 76, has opposite ends connected to the latch means 66 and to one or both of the elongated members 22, 24. The second biasing means 74 urges the latch means 66 toward the arm means 64, its movement being limited in that direction and to that shown in FIG. 7 by stop means 78. The second biasing means 74 assures that the latch means 66 will always be in position for engagement by the remote end 70 of the arm means 64 and, when engaged, will maintain the clamping means 32 in the clamping relation illustrated in FIG. 7.

Figure 8:
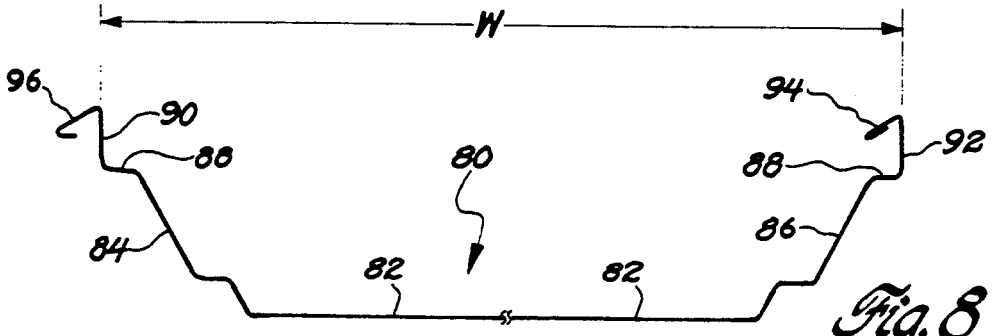
FIG. 8 is an end view illustrating a typical standing seam roof panel.

Referring to FIG. 8, there is illustrated a typical standing seam roof panel 80 having a design modular width W. In a commercial embodiment of the panel 80, the modular width M is 24 inches (9.45 cm). The panel 80 comprises a central web 82 having inclined sides 84, 86 along the opposite longitudinal edges thereof. Each of the sides 84, 86 terminates at its upper end in an outwardly extending horizontal shoulder 88. Upstanding ribs 90, 92 project upwardly from the shoulders 88 and terminate in downwardly sloped male and female flanges 94, 96, respectively. The arrangement is such that as shown in FIG. 9, the female flange 96B of one panel 80B is engaged over the male flange 94A of an adjacent panel 80A, while the upstanding ribs 90B, 92A are disposed in side-by-side piston, thereby forming a panel joint 98. Thereafter the panel joint 98 is seamed, as shown in FIG. 10 by mechanical and motorized seaming devices to provide a weathertight seam.

FIG. 11 illustrates typical mounting clip means 100 comprising a clip 102 which is adapted to be secured to roofing purlins, and a tab 104 which is connected to the clip 102 by connector means 106 extending through an elongated slot 108 in the clip 102. The tab 104 slides in the slot 108 in response to thermal expansion and contraction of the roof panels 80 (FIG. 8). the tab 104 has a lower portion 110 provided with a dimple 112 which engages an opening (not visible) in the clip 102. The dimple 112 cooperates with the opening to maintain the tab 104 essentially center with respect to the slot 108. The tab 104 includes a vertical portion 114 terminating at its upper edge in an inclined flange 116. The vertical portion 114 and the flange 116 are shown in dotted outline in FIGS. 9 and 10 to illustrates the tab 104 residing within the panel joint 98.

Figure 7:
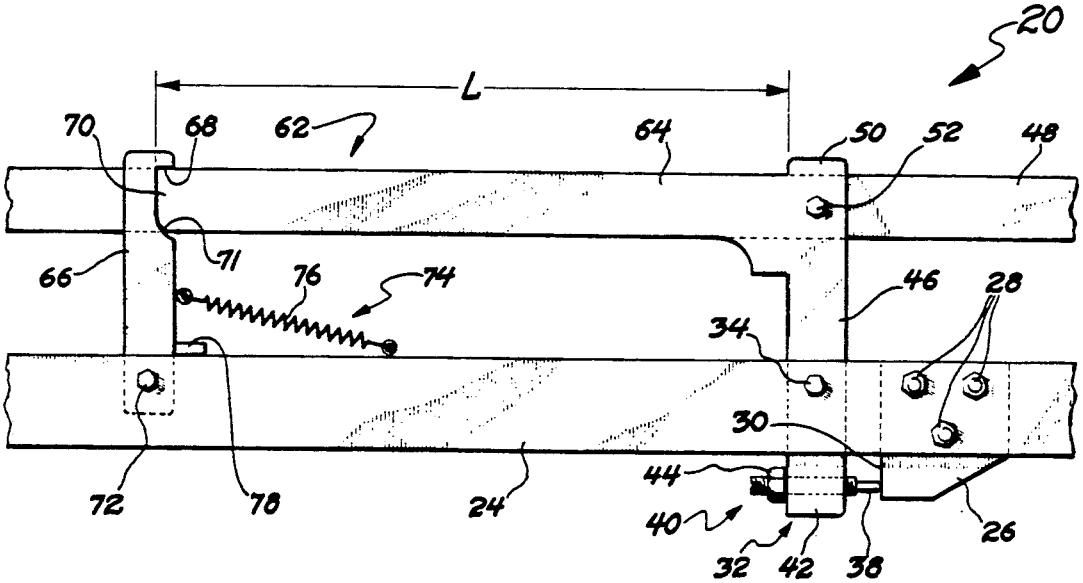
FIG. 7 is a fragmentary side view illustrating operating means for effecting pivotal movement of the clamping means.

It will be observed by comparison of FIGS. 7 and 12, that by deflecting the latch means 66 to the left, as viewed in FIG. 7, the arm means 64 is released. The first biasing means 54 (FIG. 6) causes all of the crank means 46 to be rotated clockwise about the pivot means 34 such that the arm means 64 is raised to the position illustrated in FIG. 12, and causes all of the clamping means 32 to be rotated away from and into the spaced-apart relation shown in FIG. 12.

FIG. 12, illustrates a roof structure 118 being erected wherein roof panels 80C and 80D have been moduled to conform their widths to the design modular width M, and secured to purlins 120 (only one visible) by the clip means 100.

For illustrative purposes, the next-to-be-erected roof panel 80E is illustrated as having an actual transverse width M+ which is greater than the design modular width M. The module gauge 20 is placed over the panels 80C–80E. Since the panel 80E is wider than required, the face 30 of the endmost abutment means 26E is engaged with the upstanding rib 92E. Note that the faces 30 of the remaining abutment means 26 are spaced-apart from the panel joints 98C, 98D by an amount equal to the amount by which the panel 80E exceeds the design modular width M.

Figure 13:
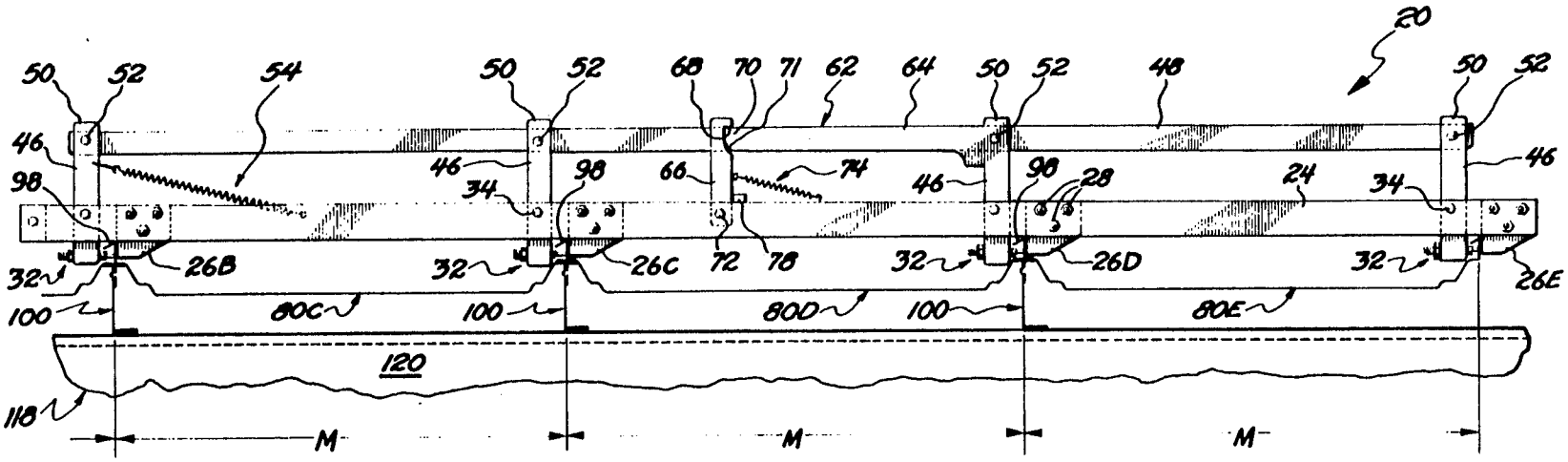
FIG. 13 is a view, similar to FIG. 12, wherein the module gauge has laterally compressed the over-width roof panel to the design modular width.
Figure 14:
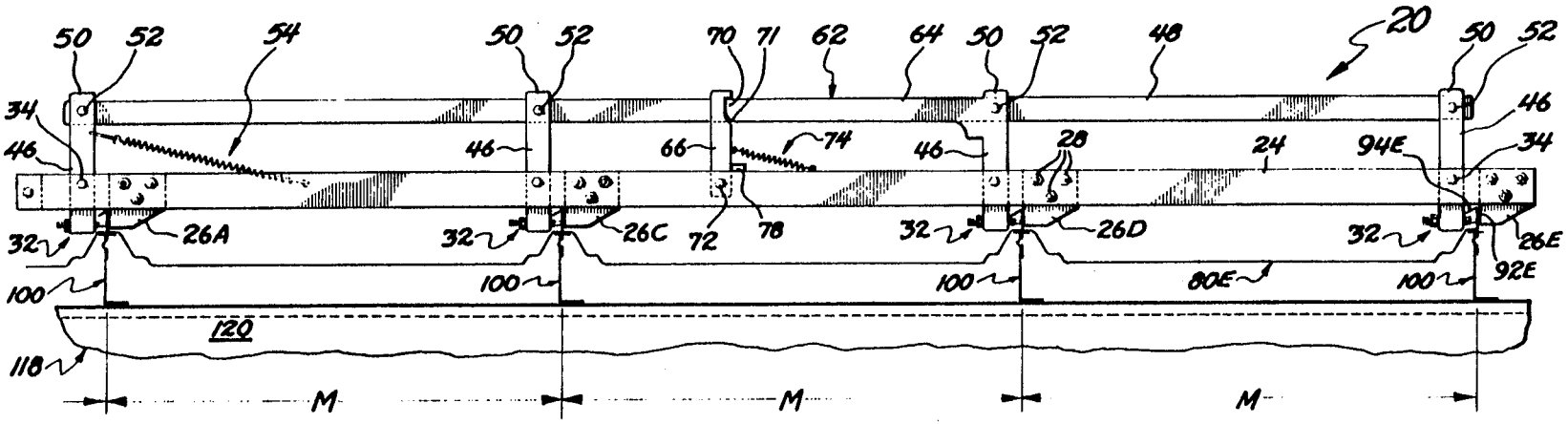
FIG. 14 is a side view, similar to FIG. 12, wherein one of the clips of FIG. 11 is connected to the just-conformed panel and is secured to the supporting steel purlins.

It will be appreciated that by lowering the arm means 64, all of the clamping means 32 are rotated into engagement with the panel joints 98C, 98D and thereafter continued lowering of the arm means 64 causes the end abutment means 26E to force the roof panel 80E to undergo transverse contraction such that, as illustrated in FIG. 13, its width now equals the design modular width M. The remote end 70 of the arm means 64 engages the recess 68 of the latch means 66 and is retained therein. The moduled panel 80E is now secured to the purlins 120 by the panel mounting clip means 100 as shown in FIG. 14. At this time, the arm means 62 is released and raised and the module gauge 20 is moved and the above described process is repeated for each subsequently erected roof panel.

It will be observed that all of the clamping means 32 clamp the panel joints 98C, 98D to the adjacent abutment means 26. By employing a module gauge 20 having four clamping means 32 and, four abutment means 26, the gauge 20 utilizes the joints 98C, 98D formed between the three previously erected roof panels as fixed points by which moduling of the next-to-be-erected roof panel 80E is measured.

It will be appreciated that if, instead, the roof panel 80E had an actual width (M−) which was less than the module width M, the abutment means 26C, 26D would have been engaged with the panel joints 98C, 98D; and the endmost abutment means 26E would have been spaced-apart from the upstanding rib 92E. Lowering of the arm means 64 would cause the panel 80E to be stretched laterally to conform its actual width with the design modular width M.

It should be readily apparent from the foregoing that present invention provides a module gauge capable of positively clamping and locking onto multiple roof panels in one motion; by which the width of the next-to-be-erected roof panel is conformed to the design modular width by expanding or compressing the panel as needed; by which panel coverage is made to conform to the coverage required by the structural steel framework; and by which water leakage caused by misalignments is eliminated so as to provide a roofing system having maximum weathertightness.

We claim:

1. A module gauge comprising:
at least one elongated member;
plural abutment means secured to said elongated member at uniformly spaced locations thereon;
clamping means, each pivotally connected to said elongated member for arcuate movement toward and away from said abutment means;
operating means for effecting pivotal movement of said clamping means, in unison, into clamping relation with said abutment means.

2. The module gauge as defined in claim 1 wherein each of said clamping means includes:
a clamping element; and
adjustment means for adjusting the relative spacing between said clamping element and the adjacent one of said abutment means.

3. The module gauge as defined in claim 1 including:
means for biasing said clamping means away from and into spaced-apart relation with said abutment means.

4. The module gauge as defined in claim 1 wherein said clamping means are pivotal about axes extending generally perpendicular to said elongated member.

5. The module gauge as defined in claim 1 including:
a second elongated member on that side of said abutment means opposite the first said elongated member;
said abutment means being secured to said second elongated member; and
said clamping means being pivotally connected to said second elongated member.

6. The module gauge as defined in claim 1 wherein said operating means includes:
plural crank means, each associated with one of said clamping means;
a tie member extending across and pivotally connected to all of said crank means; and
operating arm means for moving said tie member and hence pivotally moving said clamping means in unison.

7. The module gauge as defined in claim 6 wherein said operating arm means extends from one of said crank means.

8. The module gauge as defined in claim 6 including:
releasable latch means engageable with said operating arm means for maintaining said clamping means in said clamping relation.

9. A module gauge comprising:
at least one elongated member;
plural abutment means secured to said elongated member at uniformly spaced locations thereon;
plural crank means, each adjacent to one of said abutment means;
pivot means pivotally connecting said crank means to said elongated member;
clamping means, each supported by one of said crank means in opposed relation with an adjacent one of said abutment means;
a tie member pivotally connected to all of said crank means;
first means biasing said clamping means away from said abutment means; and
operating arm means for effecting pivotal movement of said clamping means, in unison, into a clamping relation with said abutment means.

10. The module gauge as defined in claim 9 including:
releasable latch means engageable with said operating arm means for maintaining said clamping means in said clamping relation.

11. The module gauge as defined in claim 9 wherein each of said clamping means includes:
a clamping element; and
adjustment means for adjusting the relative spacing between said clamping element and said abutment means.

12. A module gauge comprising:
a pair of elongated members;
plural abutment means disposed between and secured to said elongated members at uniformly spaced locations thereon;
plural crank means disposed between and pivotally connected to said elongated members;
clamping means, each connected to one of said crank means and presented in opposed relation to an adjacent one of said abutment means;

a tie member pivotally connecting corresponding ends of said crank means;

spring means biasing said clamping means away from said abutment means; and arm means for effecting pivotal movement of said clamping means, in unison, into clamping relation with said abutment means.

13. The module gauge as defined in claim 12 including:

latch means releasibly engaged with aid arm means, for retaining said clamping means in clamping relation with said abutment means.

14. The module gauge as defined in claim 12 wherein each of said clamping means includes:

a clamping element; and adjustment means for adjusting the relative spacing between said clamping element and said abutment means.

15. The module gauge as defined in claim 12 wherein each of said clamping means includes:

a clamping element; and adjustment means for adjusting the relative spacing between said clamping element and the adjacent one of said abutment means.

16. The module gauge as defined in claim 12 wherein said arm means extends from one of said crank means.

* * * * *